United States Patent [19]

Taguchi et al.

[11] Patent Number: 4,988,666

[45] Date of Patent: Jan. 29, 1991

[54] THERMAL DYE TRANSFER SHEET

[75] Inventors: Nobuyoshi Taguchi; Akihiro Imai, both of Ikoma; Yukichi Murata, Sagamihara; Takao Hirota, Machida, all of Japan

[73] Assignees: Mitsubishi Kasei Corporation; Matsushita Electric Industrial Co., Ltd., Japan

[21] Appl. No.: 276,103

[22] Filed: Nov. 23, 1988

[30] Foreign Application Priority Data

Nov. 25, 1987 [JP] Japan ..... 62-296451

[51] Int. Cl.[5] ..... B41M 5/035; B41M 5/26

[52] U.S. Cl. ..... 503/227; 8/471; 428/195; 428/216; 428/913; 428/914

[58] Field of Search ..... 8/471; 428/195, 913, 428/914, 216; 503/227

[56] References Cited

U.S. PATENT DOCUMENTS 4,032,691 6/1977 Kido et al. ..... 428/304

FOREIGN PATENT DOCUMENTS 2609937 7/1988 France .

2159971 12/1985 United Kingdom . .

OTHER PUBLICATIONS

Patent Abstracts of Japan, vol. 8, No. 207 (M-327) [1644] 9/21/84, JPA-59-96993; 6/4/84.

*Primary Examiner*—Bruce H. Hess

*Attorney, Agent, or Firm*—Jordan B. Bierman

[57] ABSTRACT

A thermal yellow-dye transfer sheet that comprises a base film having thereon a dye layer comprising a yellow-dye dispersed in a binder which comprises at least one dye represented by the general formula (I) and at least one dye represented by the general formula (II):

[I]

where X is hydrogen or halogen and Y is hydrogen, $COOR^3$ or $CONR^4R^5$ (where $R^3$, $R^4$ and $R^5$ each represents hydrogen, a substituted or unsubstituted alkyl, cycloalkyl, allyl or a substituted or unsubstituted aryl).

[II]

where Z is hydrogen, chlorine or a lower alkyl, and $R^1$ and $R^2$ each represents a substituted or unsubstituted alkyl, cycloalkyl, allyl, or a substituted or unsubstituted aryl.

18 Claims, 1 Drawing Sheet

THERMAL DYE TRANSFER SHEET

DETAILED DESCRIPTION OF THE INVENTION

1. Field of the Invention

The present invention relates to a transfer sheet useful in thermal sublimable dye transfer recording. The present invention more particularly relates to a yellow-color developing thermal sublimable dye transfer sheet.

2. Prior Art

In order to meet the need for obtaining color records with facsimile printers and copying machines or from TV pictures, various color recording techniques are under review, including those based on electrophotography, ink-jet printing and thermal transfer.

The thermal transfer recording system involves easy maintenance and operation of the equipment. In addition, the apparatus and consumable supplies used with this system are inexpensive. Therefore, it is held to be advantageous over the other color recording systems.

The thermal transfer recording system is divided into two types: one is of a melting type in which a transfer sheet having a heat-fusible ink layer formed on a base film is heated with a thermal head so that the ink is fused in an imagewise pattern and transferred onto a recording element; the other is of a sublimation type in which a transfer sheet having a sublimable dye containing ink layer formed on a base film is heated with a thermal head so that the dye is allowed to sublime in an imagewise pattern and transferred onto a recording element. In the recording of the sublimation type, the amount in which the dye sublimes and forms a transfer image can be controlled by changing the energy to be imparted to the thermal head and this facilitates the recording of an image in gradation. This system is therefore considered to be of particular advantage for the purpose of full-color recording.

In thermal transfer recording of the sublimation type, the sublimable dye which is used in the transfer sheet bears great importance since it causes substantial effects on such factors as the speed of transfer recording, the quality of a record and its storage stability. The sublimable dye to be incorporated in the transfer sheet are therefore required to satisfy the following conditions:

(1) it should readily sublime under the operating conditions of a thermal recording head;

(2) it should not decompose thermally under the operating conditions of the thermal recording head;

(3) it should be capable of reproducing a desired color;

(4) it should have a high molecular extinction coefficient;

(5) it should be stable against heat, light, moisture a0d chemicals;

(6) it should be easy to synthesize;

(7) it should have good adaptability for preparing ink formulations; and (8) it should cause no safety or hygienic problems.

The dyes represented by the general formulas (I) and (II) which are to be used in the present invention are both capable of forming a bright yellow color and thermal transfer sheets using them individually are already known. For example, some of the dyes of the general formula (I) are disclosed as thermal transfer dyes in JP-A-60-53565 (the term "JP-A" as used herein means an "unexamined published Japanese patent application"). Some of the dyes of the general formula (II) are also disclosed as thermal transfer dyes in such prior patent applications as JP-A-59-78895, JP-A-59-94124, JP-A-60-28451, JP-A-60-28453 and JP-A-60-53564. Dye transfer elements that employ some of these dyes alone are disclosed in JP-A-60-253594 and JP-A-60-253596.

Thermal transfer sheets that use quinophthalone dyes of general formula (I) alone are capable of producing records having very high storage stability but on the other hand, their sensitivity is low and great energy is required to attain adequate recording density. In contrast, thermal transfer sheets that use styryl dyes of general formula (II) alone have very high sensitivity and need only low energy to produce satisfactory recording density. However, the records produced from these sheets are low in keeping stability, especially in lightfastness.

SUMMARY OF THE INVENTION

An object, therefore, of the present invention is to provide a thermal yellow-dye transfer sheet that has a sufficiently high sensitivity to permit transfer recording with low energy, and which produces a record having high keeping stability.

DETAILED DESCRIPTION OF PREFERRED EMBODIMENTS

According to the present invention there is to provide a thermal yellow-dye transfer sheet that comprises a base film having thereon a dye layer comprising a yellow dye dispersed in a binder which comprises at least one dye represented by the following general formula (I) and at least one dye represented by the following general formula (II):

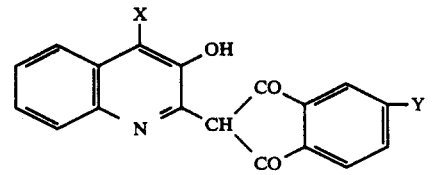

[I]

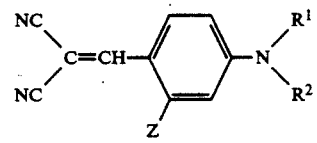

[II]

In formula (I), X is hydrogen or halogen and Y is hydrogen, $COOR^3$ or $CONR^4R^5$ (where $R^3$, $R^4$ and $R^5$ each represents hydrogen, a substituted or unsubstituted alkyl, cycloalkyl, allyl or a substituted or unsubstituted aryl).

In formula (II), Z is hydrogen, chlorine or a lower alkyl, and $R^1$ and $R^2$ each represents a substituted or unsubstituted alkyl, cycloalkyl, allyl, or a substituted or unsubstituted aryl.

BEST MODE CARRYING OUT THE INVENTION

Figure 1:
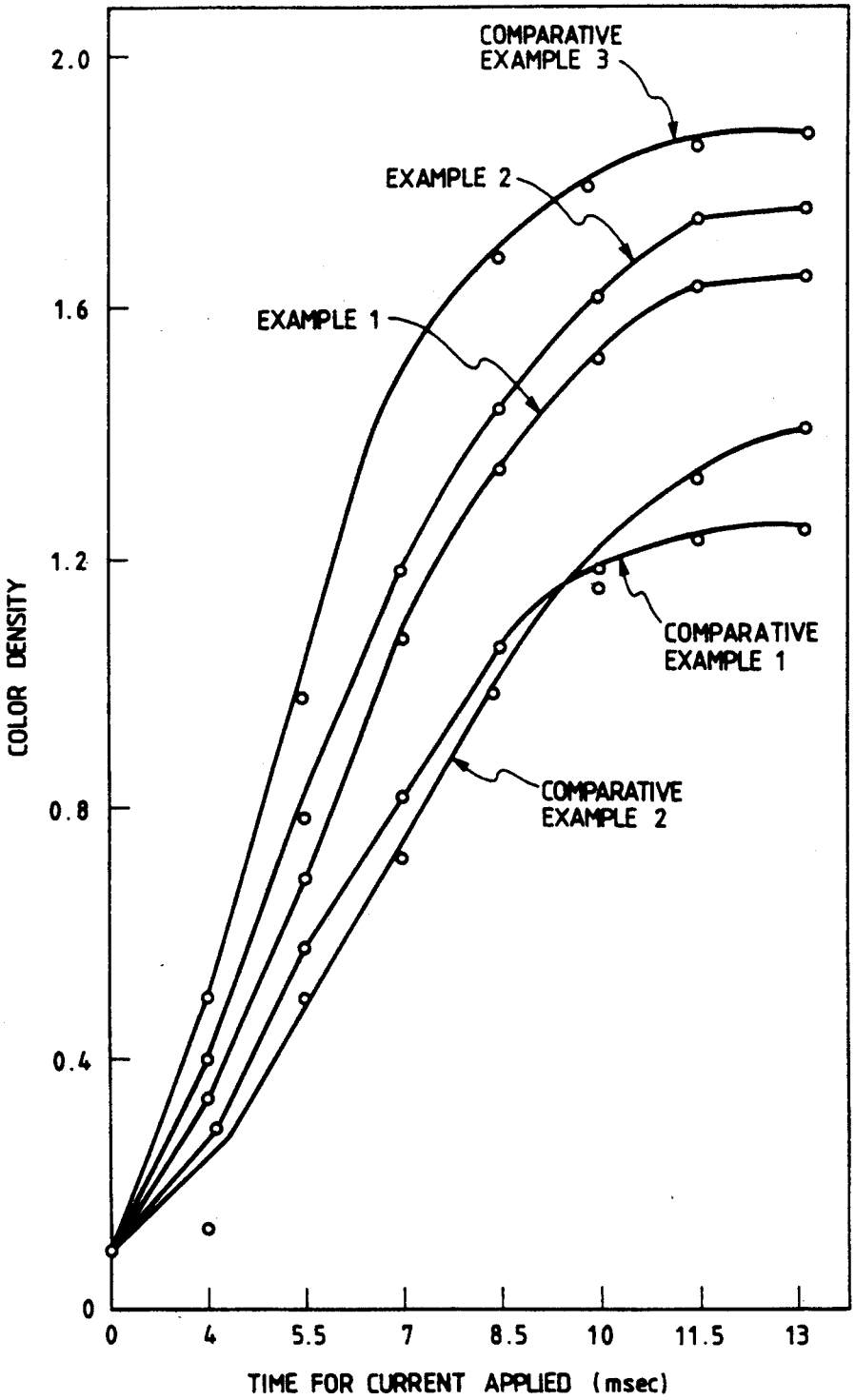
FIG. 1 is a graph showing the recording characteristics that were obtained when thermal recording was conducted with the transfer sheets prepared in Examples 1 and 2, as well as in Comparative Examples 1, 2 and 3. In the diagram, the vertical axis plots color density, and the horizontal axis plots the duration of time in milliseconds for which an electric current was applied to the thermal head.
Figure 2:
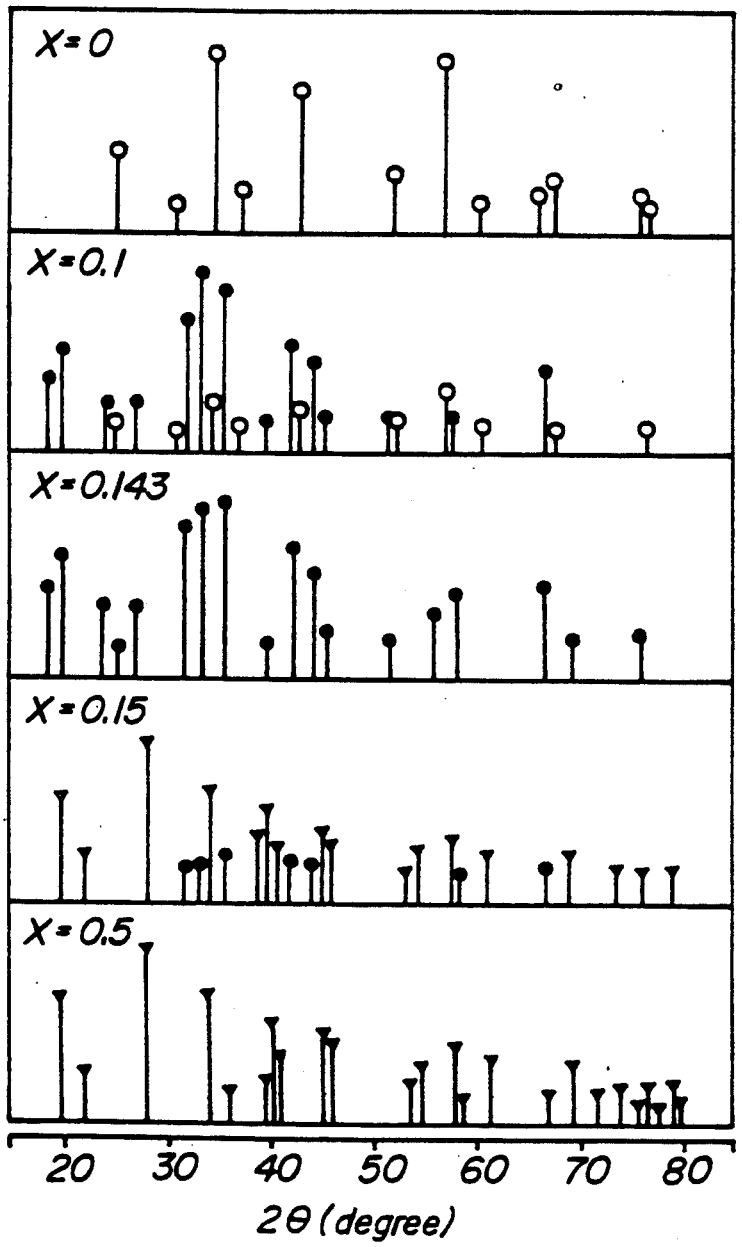
Figure 3:
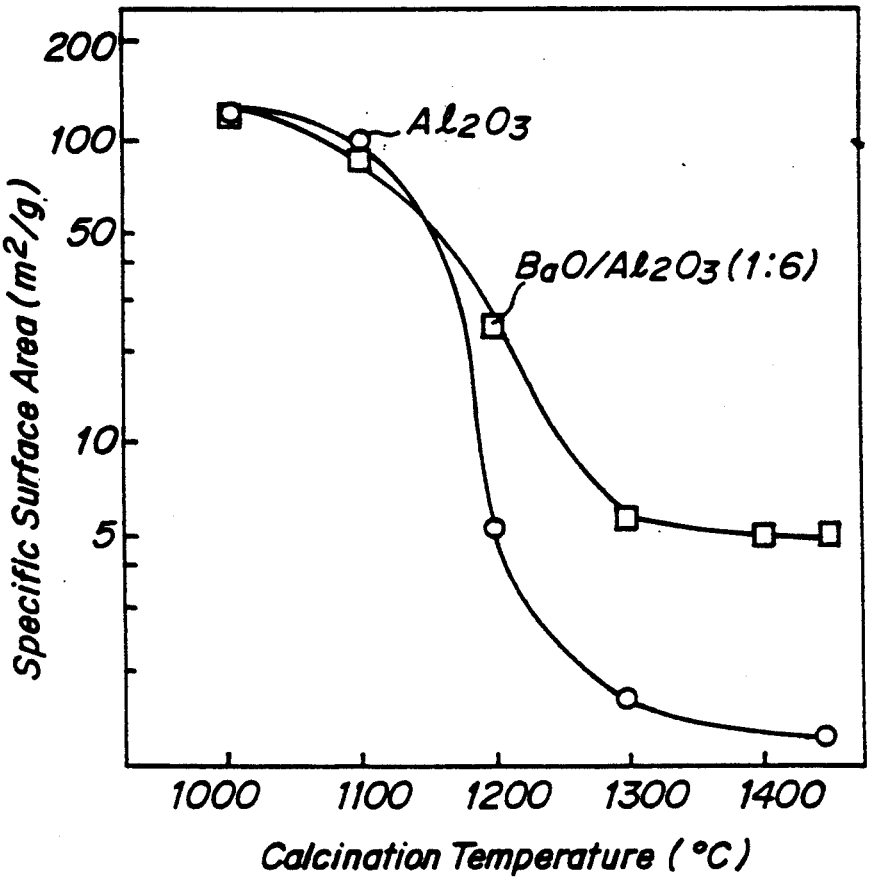
Figure 4:
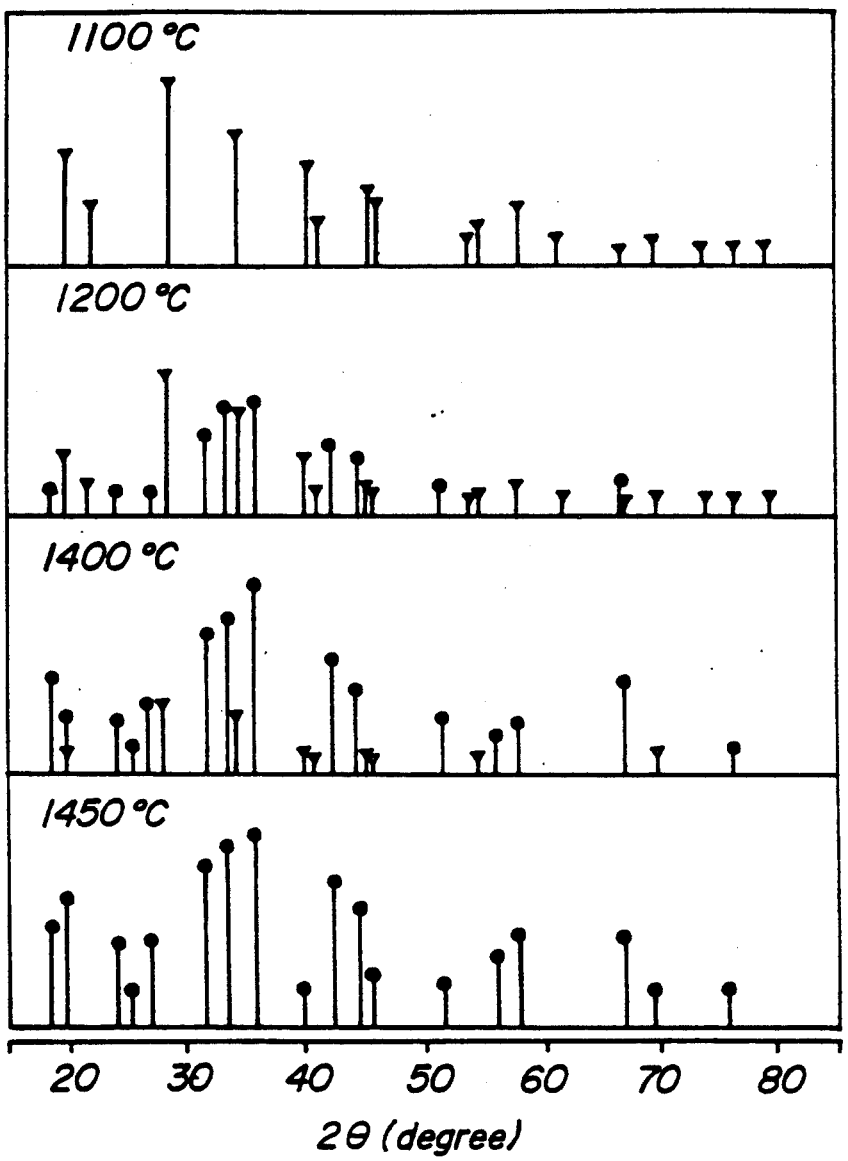
Figure 5:
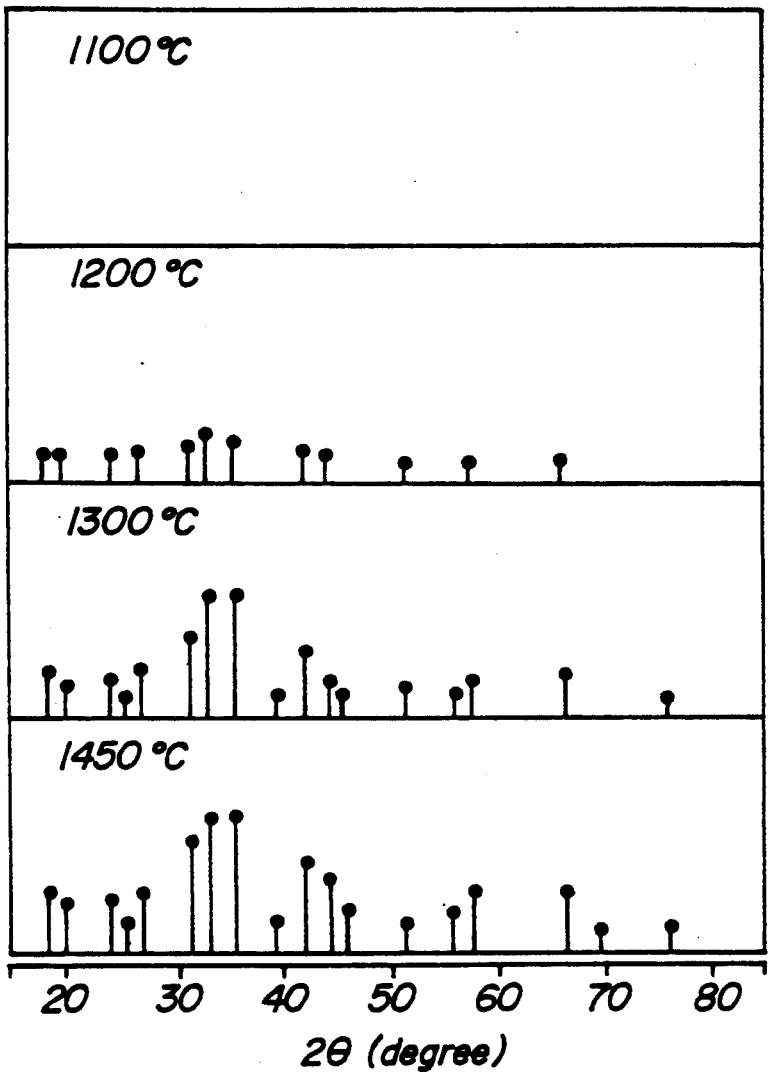

Preferred embodiments of the present invention are described hereinafter in detail.

The dyes to be used in the present invention are represented by the general formulas (I) and (II). Examples of the halogen atom denoted by X in general formula (I) include chlorine and bromine atoms Examples of the lower alkyl group denoted by Z in general formula (II) include linear and branched $C_{1-4}$ alkyl groups.

Examples of the unsubstituted alkyl group denoted by each of $R^1$–$R^5$ in general formulas (I) and (II) include linear or branched alkyl groups of $C_{1-12}$; examples of the substituted alkyl group include linear or branched $C_{1-12}$ alkyl groups that are substituted by alkoxy, alkoxyalkoxy, aryloxy, allyloxy, aralkyloxy, aryl, cyano, hydroxy, halogen atom, furyl, tetrahydrofuryl, alkoxycarbonyl, allyloxycarbonyl, and acyloxy, etc.

Examples of the alkoxy-substituted alkyl group include: 2-methoxyethyl, 2-ethoxyethyl, 2-(n)propoxyethyl, 2-(iso)propoxyethyl, 2-(n)butoxyethyl, 2-(iso)-butoxyethyl, 2-(sec)butoxyethyl, 2-(n)pentyloxyethyl, 2-(n)hexyloxyethyl, 2-(n)octyloxyethyl, 2-(2'-ethylhexyloxy)ethyl, 1-methyl-2-methoxyethyl, 1-methyl-2-ethoxyethyl, 1-methyl 2-(n)propoxyethyl, 1-methyl-2-(iso)-propoxyethyl, 1-methyl-2-(n)butoxyethyl, 1-methyl-2-(iso)butoxyethyl, 1-methyl-2-(n)hexyloxyethyl, 1-methyl-2-(2'-ethylhexyloxy)ethyl, 3-methoxybutyl, 3-ethoxybutyl, 1-ethyl-2-methoxyethyl, and 1-ethyl-2-ethoxyethyl. Among these alkoxy-substituted alkyl groups, β-alkoxy-ethyl groups having 3 to 8 carbon atoms are particularly preferred.

Examples of the aralkyloxy-substituted alkyl group include: 2-benzyloxyethyl, 1-methyl-2-benzyloxyethyl, 1-ethyl-2-benzyloxyethyl, and 2-(β-phenylethyl)oxyethl.

Examples of the allyloxy-substituted alkyl group include: 2-allyloxyethyl, 1-methyl-2-allyloxyethyl, and 1-ethyl 2 allyloxyethyl.

Examples of the aryloxy-substituted alkyl group include: 2-phenoxyethyl, 1-methyl-2-phenoxyethyl and 1-ethyl-2-phenoxyethyl.

Examples of the alkoxyalkoxy-substituted alkyl group include: 2-(2'-methoxyethoxy)ethyl, 2-(2'-ethoxyethoxy)ethyl, 2-[2'-(n)butoxyethoxy]ethyl, 2-[2'-(n)-hexyloxyethoxy]ethyl, 2-[2'-(n)octyloxyethoxy]ethyl, 2-[2'-(iso)butoxyethoxy]ethyl, 1-methyl-2-(2'-methoxyethoxy)ethyl, 1-methyl-2-[2'-(n)butoxyethoxy]ethyl, and 3-(2'-methoxyethoxy)butyl. Among these alkoxyalkoxy-substituted alkyl groups, β-(β'-alkoxyethoxy)thyl groups having 5 to 10 carbon atoms are particularly preferred.

Examples of the cyano-substituted alkyl group include 2-cyanoethyl and cyanomethyl; examples of the hydroxy-substituted alkyl group include 2-hydroxyethyl 3-hydroxy(n)propyl, 4-hydroxy(n)butyl, 1-methyl-2-hydroxyethyl and 1-ethyl-2-hydroxyethyl; examples of the halogen substituted alkyl group include 2-chloroethyl, 2-bromoethyl and 2,2,2-trifluoroethyl; examples of the furyl-substituted alkyl group include furfuryl; example of the tetrahydrofuryl-substituted alkyl group include tetrahydrofurfuryl; examples of the aryl-substituted alkyl group include benzyl, p-chlorobenzyl, and 2-phenylethyl.

Examples of the alkoxycarbonyl-substituted or allyloxycarbonyl-substituted alkyl group include 2-methoxycarbonylethyl, 2-ethoxycarbonylethyl, 2-(iso)-butoxycarbonylethyl, 2-(n)hexyloxycarbonyl, 1-methyl-2-methoxy-carbonylethyl, 1-methyl-2-(n)butoxycarbonylethyl, 2-allyloxycarbonylethyl, 1-methyl-2-allyloxycarbonylethyl, methoxycarbonylmethyl, ethoxycarbonylmethyl, (iso)-butoxycarbonylmethyl, (n)hexyloxycarbonylmethyl, and 2-ethylhexyloxycarbonylmethyl.

Examples of the acyloxy-substituted alkyl group include: 2-acetoxyethyl, 2-propinonyloxyethyl, 2-benzoyloxyethyl, 3-acetoxy(n)propyl, 4-acetoxy(n)butyl, 1-methyl-2-acetoxyethyl, and 1-ethyl-2-acetoxyethyl.

Examples of the cycloalkyl group denoted by each of $R^1$ to $R^5$ in general formulas (I) and (II) include cyclopentyl and cyclochexyl.

The aryl group denoted by each of $R^1$ to $R^5$ in general formulas (I) and (II) may be a substituted or unsubstituted phenyl group. Illustrative substituents include a lower alkyl group having 1 to 4 carbon atoms, a lower alkoxy group having 1 to 4 carbon atoms, a halogen atom such as a fluorine, chlorine or bromine atom, and a trifluoromethyl group.

Among the dyes represented by the general formula (I), those which are represented by the following structural formulas (III) and (IV) are preferred:

[III]

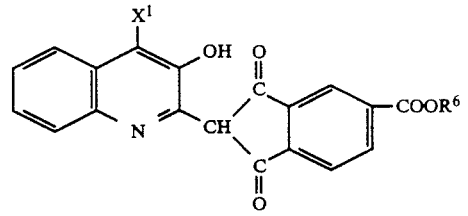

(where $X^1$ is hydrogen or halogen, and $R^6$ is alkyl, alkoxyalkyl, aralkyloxyalkyl, allyloxyalkyl, aryloxyalkyl, tetrahydrofurfuryl, furfuryl, cycloalkyl, allyl or aralkyl); and

[IV]

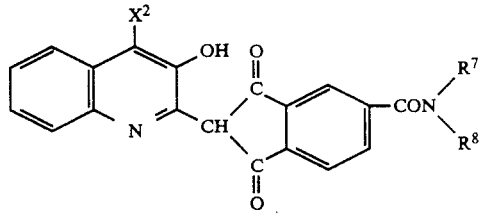

(where $X^2$ is hydrogen or halogen, and $R^7$ and $R^8$ each represents hydrogen atom, alkyl, alkoxyalkyl, cycloalkyl, allyl, optionally substituted aryl, aralkyl, furfuryl, tetrahydrofurfuryl or hydroxyalkyl).

Specific examples of $X^1$ in general formula (III) include hydrogen, bromine and chlorine atoms Hydrogen and bromine atoms are preferred, and hydrogen atom is more preferred. Examples of $R^6$ are $C_{1-12}$ alkyl groups, preferably $C_{4-12}$ alkyl groups and more preferably $C_{5-8}$ alkyl group.

Specific examples of $X^2$ in general formula (IV) include hydrogen, bromine and chlorine atoms. Hydrogen and bromine atoms are preferred Examples of $R^7$ and $R^8$ are $C_{1-12}$ alkyl groups, preferably $C_{1-4}$ alkyl groups and more preferably $C_3$ or $C_4$ alkyl group.

With respect to dyes represented by the general formula (II), Z in the formula is hydrogen or $C_{1-4}$ alkyl, preferably hydrogen or methyl, methyl being particularly preferred. Examples $R^1$ and $R^2$ are substituted or unsubstituted alkyl, preferably $C_{1-8}$ alkyl group, $C_{3-8}$ alkoxyalkyl, benzyl, β-phenylethyl, β-cyanoethyl, β-chloroethyl, β-hydroxyethyl or allyl. A more preferred embodiment is such that Z is methyl and one of $R^1$ and $R^2$ is $C_{1-8}$ alkyl and the other is benzyl or a β-phenylethyl qroup.

The present invention relates to a thermal dye transfer sheet having a dye layer which has incorporated therein a dye represented by the general formula (I) set forth above and a dye represented by the general formula (II) also set forth above. These two dyes are of such a combination that, when incorporated in the same layer, they exhibit their own characteristics effectively without impairing each other's characteristics. By employing such dyes, the present invention is capable of providing an improved thermal dye transfer sheet.

The weight ratio of the dye of formula (I) to the dye of formula (II) is preferably within the range of from 1:5 to 5:1, more preferably in the range of from 1:2 to 5:1. Incorporating two or more dyes of formula (I) contributes to improved solubility and hence is preferred for the purposes of the present invention. If two or more dyes of formula (I) are to be used, they may be selected from the group of dyes of general formula (III) or from the group of dyes of general formula (IV). If necessary, dyes of formula (III) may be mixed with dyes of formula (IV). Particularly preferred selections are as follows: at least two of the dyes general formula (III) where $X^1$ is hydrogen or bromine, and $R^6$ is $C_{4-12}$ alkyl; at least two of the dyes of general formula (IV) where $X^2$ is hydrogen or bromine, and $R^7$ and $R^8$ are each $C_{1-4}$ alkyl; or at least one of the dyes of formula (III) where $X^1$ is hydrogen and $R^6$ is $C_{5-8}$ alkyl is combined with at least one of the dyes of formula (IV) where $X^2$ is hydrogen atom or bromine atom and $R^7$ and $R^8$ are each $C_3$ or $C_4$ alkyl. These dyes of formula (I) are preferably combined with a dye of the general formula (II) where Z is methyl and one of $R^1$ and $R^2$ is $C_{1-8}$ alkyl and the other is benzyl or β-phenylethyl.

There is no particular limitation on the method that can be employed to form a dye layer using the above-described dyes in the production of the thermal dye transfer sheet of the present invention. A typical method would proceed as follows; the dyes are either dissolved or dispersed as fine particles in a medium together with a binder to prepare an ink; the ink is then coated on a base film and dried to form a dye layer on the base film. Binders that can be used to prepare inks include water-soluble resins such as cellulose resins, acrylate based resins and starches, as well as resins that are soluble in organic solvents such as acrylic resins, methacrylic resins, polystyrene, polycarbonate, polysulfone, polyether sulfone, polyvinyl butyral, ethyl-cellulose, acetyl cellulose, polyesters, and AS resins.

Besides water, the following may be used as media for preparing inks: alcohols such as methyl alcohol, isopropyl alcohol, and isobutyl alcohol; cellosolves such as methyl cellosolve and ethyl cellosolve; aromatics such as toluene, xylene and chlorobenzene; esters such as ethyl acetate and butyl acetate; ketones such as acetone, methyl ethyl ketone, methyl isobutyl ketone and cyclohexanone, chlorine based solvents such as methylene chloride, chroloform and trichloroethylene; ethers such as tetrahydrofuran and dioxane; and other organic solvents such as N,N-dimethylformamide and N-methylpyrrolidone.

Besides the components described above, the ink formulation may contain organic or inorganic nonsublimable fine particles, dispersants, antistatics, anti-blocking agents, antifoaming agents, antioxidants, viscosity modifiers and any other necessary additives.

The base film on which the ink is coated in order to prepare the desired transfer sheet are required to meet many conditions, such as a dense and thin structure for ensuring increased thermal conductivity, high heat resistance, a high smoothness that allows a uniform transfer layer to be coated and which provides improved adhesion to the thermal head, and resistance for running ink through the base. Suitable base films that satisfy these requirements include very thin sheets of paper such as condenser paper and glassine, and films of highly heat-resistant plastics such as polyesters, polycarbonates, polyamides, polyimides, and polyaramids. These films generally have a thickness in the range of 3 to 50 μm. Among the base films listed above, polyethylene terephthalate films are particularly advantageous in consideration of such factors as mechanical strength, solvent resistance and economy.

The thermal dye transfer sheet of the present invention basically consists of a base film and a dye layer that is formed on its surface and which contains the dyes of formulas (I) and (II) described above. However, in certain cases where improved running properties with respect to the thermal head and higher heat resistance are required, a heat-resistant lubricating layer may be provided on the back surface of the sheet. This layer may generally be provided by coating a heat-resistant inert inorganic compound (e.g. fine silica particles), a lubricant, a surfactant and any other suitable additives together with a heat-resistant thermoplastic resin, thermosetting resin or photocurable resin. According to a typical method, a polycarbonate resin having a recurring unit represented by the following formula:

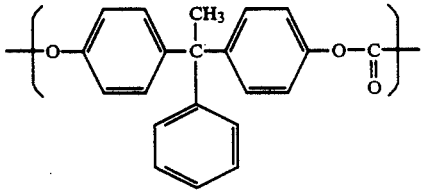

is dissolved in a solvent such as toluene and the solution is coated on a base film and dried to form a heat-resistant lubricating layer. If necessary, a phosphate ester compound may be added to the constituent of this layer and this is also a preferred embodiment. Another exemplary heat-resistant lubricating layer is composed of a photocurable acrylic resin, silicon oil, fine particulate silica, etc.

The prepared ink may be coated on the base film by any suitable means such as a reverse roll coater, a gravure coater, a rod coater or an air-doctor coater. The ink may be deposited to provide a coating having a thickness of 0.1 to 5 μm on a dry basis (see Yuji Harazaki, "Coating Systems", published by Maki Shoten, 1979).

If necessary, an adhesive layer made of resins such as polyester resins, acrylic resins, urethane resins or polyvinyl alcohol resins, taken either individually or in admixtures, may be formed between the base film and the dye layer.

A thermal head is the most common heating means for use with the thermal dye transfer sheet of the present invention but other heating media can also be used, including infrared radiation and laser light. The thermal dye transfer sheet of the present invention may be designed as a current impressable type which employs a base film that is adapted to generate heat upon application of an electric current.

The following examples are provided for the purpose of further illustrating the present invention but are in no way to be taken as limiting.

EXAMPLE 1

(a) Ink Preparation

[A]

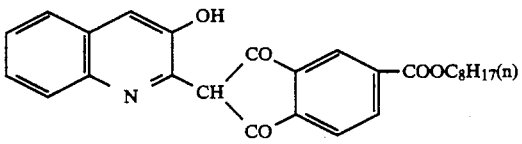

[B]

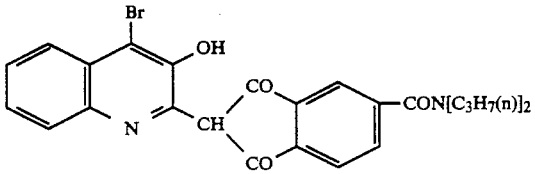

[C]

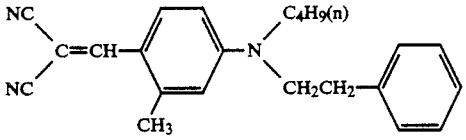

| | |
|---|---|
| Dye (A) | 1.5 g |
| Dye (B) | 3.0 g |
| Dye (C) | 1.5 g |
| Acetyl cellulose (L-30 of Daicel Chemical Industries, Ltd.) | 10.0 g |
| Methyl ethyl ketone | 80.0 g |
| Total | 96.0 g |

A mixture of the composition shown above was treated in a paint conditioner for 10 minutes to prepare ink.

(b) Preparation of Transfer Sheet

The ink was wire-bar coated on a polyethylene terephthalate film 6 μm thick that had been provided with a heat-resistant lubricating layer on its back surface. By drying the coating (dry thickness, ca. 1 μm), a transfer sheet was prepared The heat-resistant lubricating layer on the polyethylene terephthalate film was formed by the following method: a solution consisting of 8 parts by weight of a polycarbonate resin having a recurring unit of the formula:

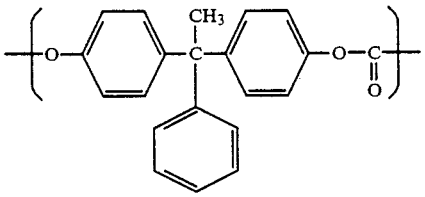

1 part by weight of a phosphate ester based surfactant (Plysurf A-208B of Dai-ichi Ko9yo Seiyaku Co., Ltd.) and 91 parts by weight of toluene was coated on the base film and dried to give a dry thickness of ca. 0.5 μm.

(c) Preparation of Image-Receiving Sheet

A solution consisting of 10 parts of a saturated polyester resin (TP-220 of The Nippon Synthetic Chemical Industry Co., Ltd.), 0.5 parts of amino-modified silicone (KF 393 of Shin-Etsu Chemical Co., Ltd.), 15 parts of methyl ethyl ketone and 15 parts of xylene was wire-bar coated on synthetic paper (Yupo FPG 150 of Oji Yuka Synthetic-Paper Co., Ltd.) and dried (dry thickness, ca. 5 μm). By subsequent heat treatment in an oven at 100° C. for 30 minutes, an image-receiving element was prepared

(d) Transfer Recording

The transfer sheet was superposed on the image-receiving sheet in such a way that the ink-coated surface was placed in contact with the latter. When recording was performed with a thermal head under the conditions set forth below, recording characteristics as shown in FIG. 1 were obtained.

| Recording conditions | |
|---|---|
| Line density for primary and auxiliary scanning | 6 dots/mm |
| Recording power | 0.21 W/dot |
| Head heating time | 0–13 msec |

Color density was measured with a densitometer, Model TR-927 of Macbeth Inc., U.S.A.

(e) Lightfastness Test

The record obtained (color density, ca. 1.0) was subjected to a lightfastness test with a carbon arc fadeometer (product of Suga Test Instruments Co., Ltd.) at a black panel temperature of 63±2° C. After exposure for 80 hours, the degree of discoloration or fading that had occurred was measured in terms of ΔE(L*a*b*) and the results are shown in Table 1. [As regarding ΔE(L*a*b*), reference is made to JIS Z-8729]

EXAMPLE 2

Ink was prepared as in Example 1 except that the dyes incorporated were dye (B) (3 g) and dye (C) (3 g). Subsequently, a transfer sheet and an image-receiving element were prepared and transfer recording performed as in Example 1. The recording characteristics obtained are shown in FIG. 1. The results of the lightfastness test conducted on the record obtained are shown in Table 1.

COMPARATIVE EXAMPLE 1

Ink was prepared as in Example 1 except that only dye (A) was incorporated in an amount of 6 g. Subsequently, a transfer sheet and an image-receiving sheet were prepared and transfer recording performed as in Example 1. The recording characteristics obtained are shown in FIG. 1. The results of the lightfastness test conducted on the record obtained are shown in Table 1.

COMPARATIVE EXAMPLE 2

Ink was prepared as in Example 1 except that only dye (B) was incorporated in an amount of 6 g. Subsequently, a transfer sheet and an image-receiving sheet were prepared and transfer recording performed as in Example 1. The recording characteristics obtained are shown in FIG. 1. The results of the lightfastness test conducted on the record obtained are shown in Table 1.

COMPARATIVE EXAMPLE 3

Ink was prepared as in Example 1 except that only dye (C) was incorporated in an amount of 6 g. Subsequently, a transfer sheet and an image-receiving sheet were prepared and transfer recording performed as in Example 1. The recording characteristics obtained are shown in FIG. 1. The results of the lightfastness test conducted on the record obtained are shown in Table 1.

TABLE 1

| Run No. | Results of the Lightfastness Test: The degree of discoloration or fading (ΔE) |
|---|---|
| Example 1 | 1.50 |
| Example 2 | 17.56 |
| Comparative Example 1 | 6.80 |
| Comparative Example 2 | 0.94 |
| Comparative Example 3 | 32.04 |

EXAMPLE 3

Ink was prepared as in Example 1 except that dyes (A), (B) and (C) were replaced by dyes (D), (E) and (F) whose formulas are shown below. Subsequently, a transfer sheet and an image-receiving element were prepared and transfer recording and a lightfastness test conducted as in Example 1. The results are shown in Table 2.

[D]

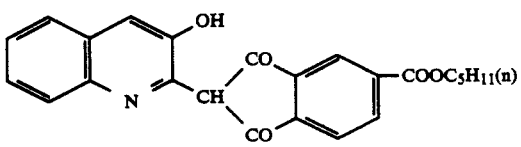

[E]

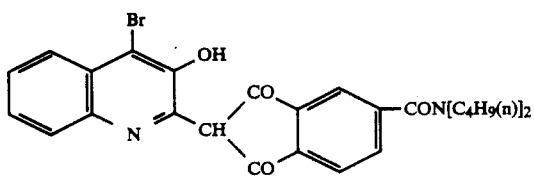

[F]

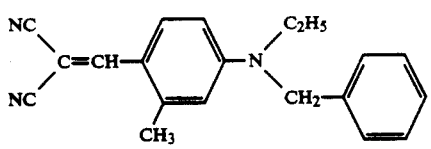

COMPARATIVE EXAMPLE 3-1

Ink was prepared as in Example 3 except that only dye (D) was used in an amount of 6 g. Subsequently, a transfer sheet and an image-receiving sheet were prepared and transfer recording and a lightfastness test conducted as in Example 3. The results are shown in Table 2.

COMPARATIVE EXAMPLE 3-2

Ink was prepared as in Example 3 except that only dye (E) was used in an amount of 6 g. Subsequently, a transfer sheet and an image-receiving sheet were prepared and transfer recording and a lightfastness test conducted as in Example 3. The results are shown in Table 2.

COMPARATIVE EXAMPLE 3-3

Ink was prepared as in Example 3 except that only dye (F) was used in an amount of 6 g. Subsequently, a transfer sheet and an image-receiving sheet were prepared and transfer recording and a lightfastness test conducted as in Example 3. The results are shown in Table 2.

TABLE 2

| Run No. | Results of Transfer Recording and Lightfastness Test: Transfer recording (recorded color density*) | Lightfastness test (discoloration or fading = ΔE) |
|---|---|---|
| Example 3 | 1.75 | 1.85 |
| Comparative Example 3-1 | 1.25 | 3.25 |
| Comparative Example 3-2 | 1.50 | 1.10 |
| Comparative Example 3-3 | 1.80 | 30.52 |

*Density of color recorded with an electric current applied to the thermal head for 10 milliseconds.

While the invention has been described in detail and with reference to specific embodiments thereof, it will be apparent to one skilled in the art that various changes and modifications can be made therein without departing from the spirit and scope thereof.

What is claimed is:

1. A thermal yellow-dye transfer sheet that comprises a base film having there on a dye layer comprising a yellow dye dispersed in a binder, said yellow dye comprising at least one dye represented by the following general formula (II) and at least two dyes represented by the following general formula (III) and/or the following general formula (IV):

[II]

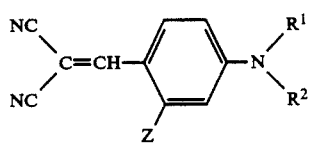

(where Z is hydrogen, chlorine or lower alkyl, and $R^1$ and $R^2$ each represents a substituted or unsubstituted alkyl, cycloalkyl, allyl, or a substituted or unsubstituted aryl);

[III]

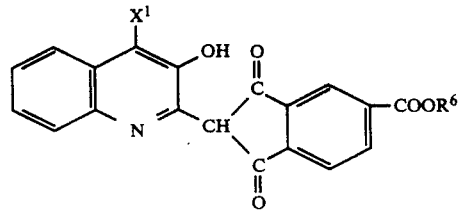

(where $X^1$ is hydrogen or halogen, and $R^6$ is alkyl, alkoxyalkyl, aralkyloxyalkyl, allyloxyalkyl, aryloxyalkyl, tetrahydrofurfuryl, furfuryl, cycloalkyl, allyl or aralkyl); and

[IV]

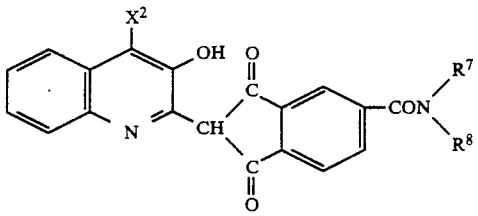

(where $X^2$ is hydrogen or halogen, and $R^7$ and $R^8$ each represents hydrogen, alkyl, alkoxyalkyl, cycloalkyl, allyl, an optionally substituted aryl, aralkyl, furfuryl, tetrahydrofurfuryl or hydroxyalkyl).

2. A thermal yellow-dye transfer sheet according to claim 1 wherein $X^1$ in the general formula (III) is hydrogen, bromine or chlorine, and $R^6$ is alkyl having 1–12 carbon atoms.

3. A thermal yellow-dye transfer sheet according to claim 1 wherein $X^1$ in the general formula (III) is hydrogen or bromine and $R^6$ is alkyl having 4–12 carbon atoms.

4. A thermal yellow-dye transfer sheet according to claim 3 wherein $R^6$ in the general formula (III) is alkyl having 5–8 carbon atoms.

5. A thermal yellow-dye transfer sheet according to claim 1 wherein $X^2$ in the general formula (IV) is hydrogen, chlorine or bromine, and $R^7$ and $R^8$ are each alkyl having 1–12 carbon atoms.

6. A thermal yellow-dye transfer sheet according to claim 1 wherein $X^2$ in the general formula (IV) is hydrogen or bromine, and $R^7$ and $R^8$ are each alkyl having 1–8 carbon atoms.

7. A thermal yellow-dye transfer sheet according to claim 6 wherein $R^7$ and $R^8$ in the general formula (IV) are each alkyl having 1–4 carbon atoms.

8. A thermal yellow-dye transfer sheet according to claim 6 wherein $R^7$ and $R^8$ in the general formula (IV) are each alkyl having 3 and 4 carbon atoms.

9. A thermal yellow-dye transfer sheet according to claim 1 wherein Z in the general formula (II) is a hydrogen or alkyl having 1–4 carbon atoms, and $R^1$ and $R^2$ are each a substituted or unsubstituted alkyl.

10. A thermal yellow-dye transfer sheet according to claim 1 wherein Z in the general formula (II) is hydrogen or methyl, and $R^1$ and $R^2$ are each alkyl having 1–8 carbon atoms, alkoxyalkyl having 3–8 carbon atoms, benzyl, β-phenylethyl, β-cyanoethyl, β-chloroethyl, β-hydroxyethyl or allyl.

11. A thermal yellow-dye transfer sheet according to claim 1 wherein Z in the general formula (II) is methyl, and one of $R^1$ and $R^2$ is alkyl having 1–8 carbon atoms and the outer is benzyl or β-phenylethyl.

12. A thermal yellow-dye transfer sheet according to claim 1 wherein at least one dye of the general formula (III) is selected where $X^1$ is hydrogen and $R^6$ is alkyl having 5–8 carbon atoms, at least one dye of the general formula (IV) is selected where $X^2$ is hydrogen or bromine and $R^7$ and $R^8$ are each alkyl group having 3 or 4 carbon atoms, and at least one dye of the general formula (II) is selected where Z is methyl and one of $R^1$ and $R^2$ is alkyl having 1–8 carbon atoms and the other is benzyl or β-phenylethyl.

13. A thermal yellow-dye transfer sheet according to claim 1 wherein the weight ratio of the dye represented by the general formula (III) and (IV) to the dye represented by the general formula (II) is within the range of from 1:5 to 5:1.

14. A thermal yellow-dye transfer sheet according to claim 1 wherein the base film has a thickness of 3–50 μm.

15. A thermal yellow dye transfer sheet according to claim 1 wherein the dye layer has a thickness of 0.1–5 μm on a dry basis.

16. A thermal yellow-dye transfer sheet according to claim 1 wherein the binder is a water-soluble resin selected from the group consisting of cellulosic resins, acrylate based resins and starches, or a resin that is soluble in organic solvents which is selected from the group consisting of (meth)acrylic resins, polystyrene, polycarbonate, polysulfone, polyether sulfone, polyvinyl butyral, ethyl cellulose, acetylpropionyl cellulose, acetyl cellulose, AS resins, ABS resins, polyester resins and phenoxy resins.

17. A thermal yellow dye transfer sheet according to claim 1 wherein at least one dye of the general formula (II) is selected where Z is hydrogen or methyl, and $R^1$ and $R^2$ each represents alkyl having 1–8 carbon atoms, alkoxyalkyl having 3–8 carbon atoms, benzyl, β-phenylethyl, β-cyanoethyl, β-chloroethyl, β-hydroxyethyl or allyl, and at least one dye of the general formula (III) are selected where $X^1$ is a hydrogen or bromine and $R^6$ is alkyl having 4–12 carbon atoms, and at least one dye of the general formula (IV) are selected where $X^2$ is hydrogen or bromine, and $R^7$ and $R^8$ each represents alkyl having 1–4 carbon atoms.

18. In a process of forming a dye transfer image comprising imagewise-heating a thermal dye transfer sheet comprising a base film having thereon a dye layer comprising a yellow dye dispersed in a binder and transferring a yellow dye image to a dye-receiving sheet to form said yellow transfer image, the improvement wherein said yellow dye comprises at least one dye represented by the following general formula and at least two dyes represented by the following general formula and/or the following general formula:

[II]

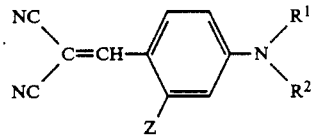

(wherein Z is hydrogen, chlorine or lower alkyl, and $R^1$ and $R^2$ each represents a substituted or unsubstituted alkyl, cycloalkyl, allyl, or a substituted or unsubstituted aryl);

[III]

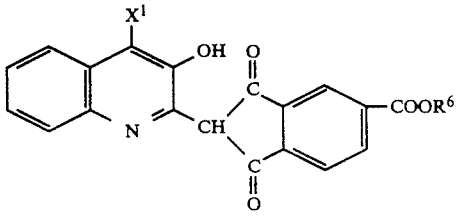

(wherein $X^1$ is hydrogen or halogen, and $R^6$ is alkyl, alkoxyalkyl, aralkyloxyalkyl, allyloxyalkyl, aryloxyalkyl, tetrahydrofurfuryl, furfuryl, cycloalkyl, allyl or aralkyl); and

[IV]

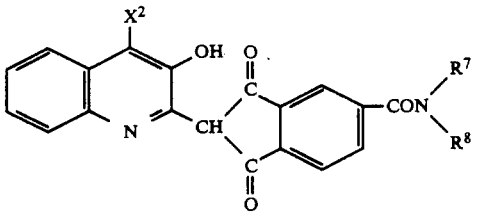

(where $X^2$ is hydrogen or halogen, and $R^7$ and $R^8$ each represents hydrogen, alkyl, alkoxyalkyl, cycloalkyl, allyl, an optionally substituted aryl, aralkyl, furfuryl, tetrahydrofurfuryl or hydroxyalkyl).

* * * * *

[IV]

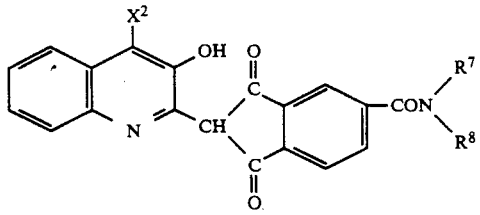

(where $X^2$ is hydrogen or halogen, and $R^7$ and $R^8$ each represents hydrogen, alkyl, alkoxyalkyl, cycloalkyl, allyl, an optionally substituted aryl, aralkyl, furfuryl, tetrahydrofurfuryl or hydroxyalkyl).

* * * * *